US005186117A

United States Patent [19]

Stallard, III

[11] Patent Number: 5,186,117

[45] Date of Patent: Feb. 16, 1993

[54] SUBMARINE STEERING APPARATUS AND METHOD

[75] Inventor: Clinton W. Stallard, III, Hampton, Va.

[73] Assignee: Newport News Shipbuilding and Dry Dock Company, Newport News, Va.

[21] Appl. No.: 786,708

[22] Filed: Nov. 1, 1991

[51] Int. Cl.[5] ..... B63G 8/16

[52] U.S. Cl. ..... 114/330; 114/144 R; 244/75 R

[58] Field of Search ..... 114/144 R, 146, 152, 114/162, 166, 312, 313, 330, 331, 332, 333, 337, 338, 23; 244/75 R, 3.1, 3.21, 3.22, 3.23

[56] References Cited

U.S. PATENT DOCUMENTS

| | | | |
|---|---|---|---|
| 3,041,992 | 7/1962 | Lee | 114/312 |
| 3,069,112 | 12/1962 | Patterson | 244/75 R |
| 3,104,641 | 9/1963 | Froehlich | 114/330 |
| 3,292,564 | 12/1966 | Lehmann | 114/338 |
| 3,450,083 | 6/1969 | Haselton et al. | 114/338 |
| 3,717,114 | 2/1973 | Bernaerts | 114/338 |
| 3,797,433 | 3/1974 | Schirtzinger | 114/330 |

*Primary Examiner*—Joseph F. Peters, Jr.
*Assistant Examiner*—Stephen P. Avila
*Attorney, Agent, or Firm*—Lalos & Keegan

[57] ABSTRACT

A submarine is steered by means of a special bow assembly. The submarine has a body formed with a contoured surface and a forward portion forming a bow. The assembly comprises an annular member surrounding the bow with an outer surface complementary to the contoured surface of the body, and actuating means secured to the body for movement of the annular member forward and away from the bow at an angle to the longitudinal axis of the vehicle. When the annular member is displaced at the angle, the vehicle is caused to turn in the direction toward which the annular member is turned.

29 Claims, 2 Drawing Sheets

SUBMARINE STEERING APPARATUS AND METHOD

BACKGROUND OF THE INVENTION

This invention relates to an apparatus for steering a vehicle through a fluid medium, and more particularly, to an apparatus for increasing maneuverability of the vehicle when traveling at low speeds.

Vehicles traveling through a fluid medium typically have a steering system unique to the type of vehicle and the fluid medium. For example, a guided missile is initially propelled and steered by the thrust of rocket motors and the like. Similarly, a vehicle traveling through water, such as a submarine, is guided by fluid flowing over stern control surfaces.

However, at low speeds, the rate of fluid flow over the stern control surfaces is insufficient to generate sufficient thrust to maintain high rates of turn. This can be undesirable when the vehicle is traveling under certain operating scenarios where a higher rate of turn is required.

The present invention has the following objects:

- an improved steering apparatus for increasing the mobility of a vehicle traveling through a fluid medium;
- an improved steering apparatus to aid in the low speed maneuverability of a vehicle traveling through a fluid medium; and
- an auxiliary improved steering apparatus providing a secondary method of steering a vehicle traveling through a fluid medium.

Other objects and advantages of the present invention will become more apparent from the following description taken in conjunction with the accompanying drawings.

DESCRIPTION OF THE PREFERRED EMBODIMENTS

Referring to the illustration of the present invention shown in FIGS. 1-5, there is illustrated a vehicle 10 propelled and steered in any conventional manner. Vehicle 10 has a body 12 with a contoured surface 14 and includes a bow 16 at the forward portion thereof. The vehicle may be, for example, a submarine or any underwater vehicle.

Figure 1:
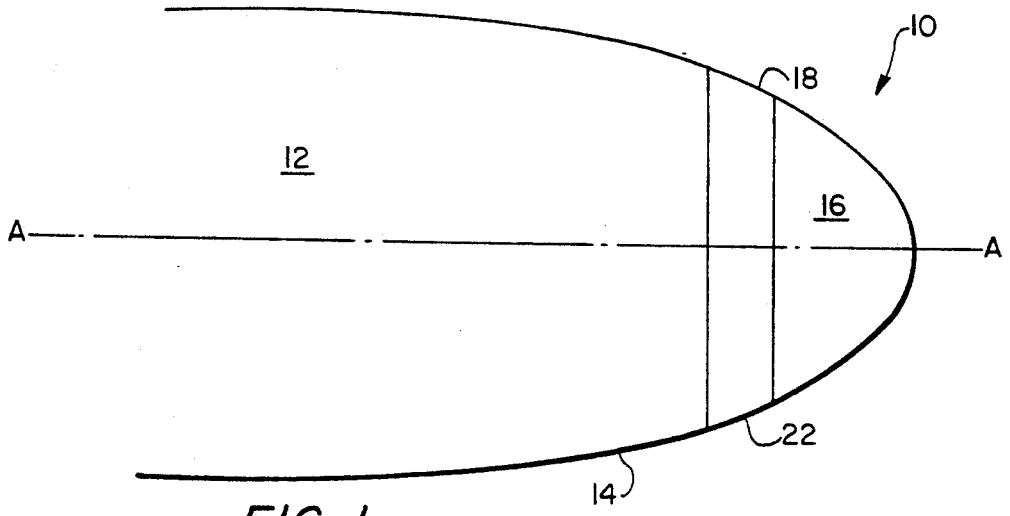
FIG. 1 is a schematic plan view of the preferred embodiment of the present invention in the retracted position.

Surrounding bow 16 is an annular member 18. Annular member 18 is movable from a retracted position, as shown in FIG. 1, to a forwardly displaced position, shown in FIGS. 2 and 3, by means of an actuating means shown generally at 20. Bow 16 includes an annular concavity 24 extending circumferentially around bow 16 and adapted to receive annular member 18 therein when the annular member is retracted. Concavity 24 may be in any location along the bow, but is preferably in the forward region of the bow where contoured surface 14 is significantly curved. Concavity 24 is of a shape conforming to the inner surface of annular member 18 and need only be of a depth sufficient to accommodate the annular member 18 and the actuating means 20.

Figure 4:
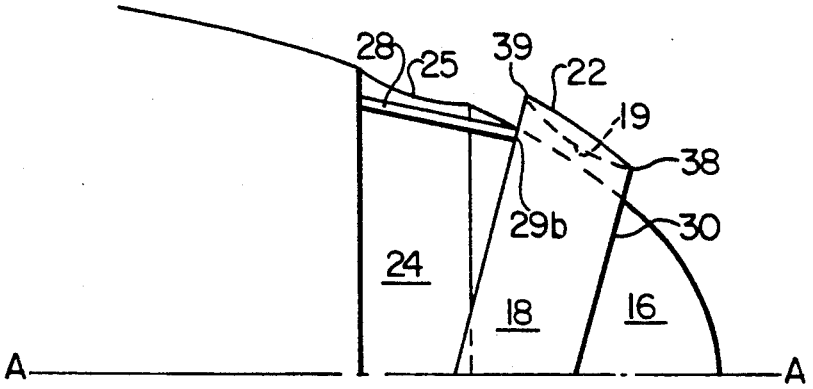
FIG. 4 is an enlarged schematic view of the embodiment shown in FIGS. 1-3 taken as indicated in FIG. 3.

As best seen in FIG. 4, concavity 24 interrupts contoured surface 14, leaving a gap 25 in the contoured surface. Referring to FIG. 1, when annular member 18 is in the retracted position, an outer surface 22 of annular member 18 is designed to continue the surface contour of the vehicle, thereby filling gap 25. It is thus evident that when annular member 18 is retracted, there is no disruption in the fluid flow about the vehicle, which might otherwise slow the vehicle and generate flow noise.

Figure 2:
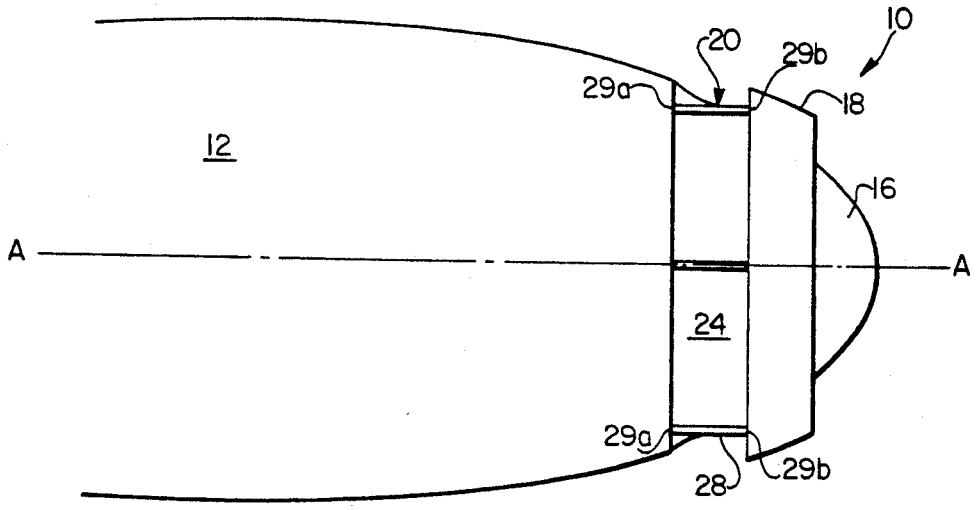
FIG. 2 is a schematic plan view of the embodiment of FIG. 1 in the fully extended position.
Figure 3:
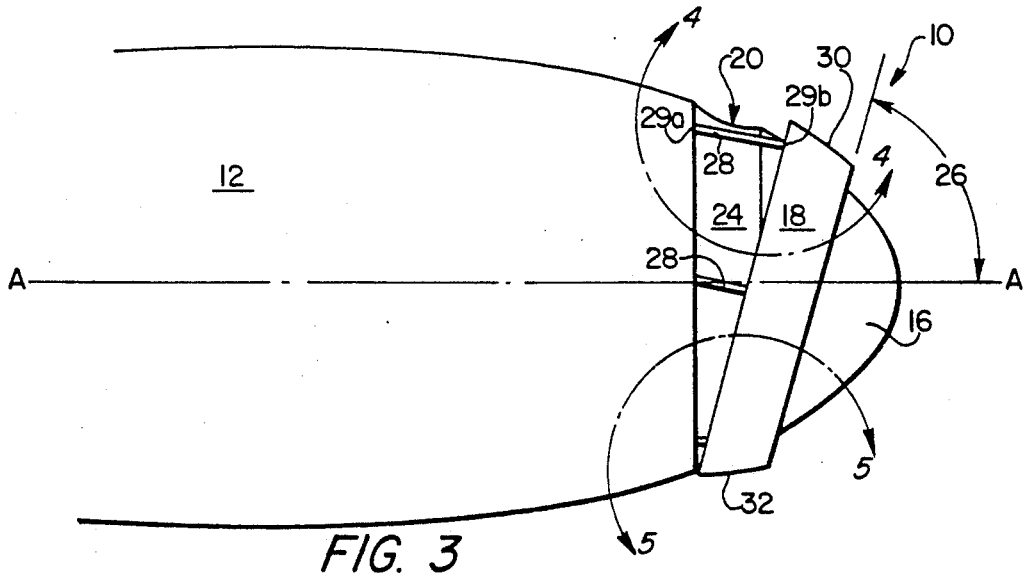
FIG. 3 is a schematic plan view of the embodiment shown in FIGS. 1 and 2 in a steering position.

Actuating means 20 is capable of displacing annular member 18 both linearly, as shown in FIG. 2, and angularly, as shown in FIG. 3. When annular member 18 is displaced linearly, the annular member is displaced forwardly out of annular concavity 24 parallel to a longitudinal axis A-A into the fluid flow about the vehicle. Referring to FIG. 3, actuating means 20 is capable of displacing annular member 18 in a direction forward and away from bow 16 at an angle 26 relative to longitudinal axis A-A of the vehicle. Angle 26 is variable as required to steer the vehicle in the intended direction.

Figure 5:
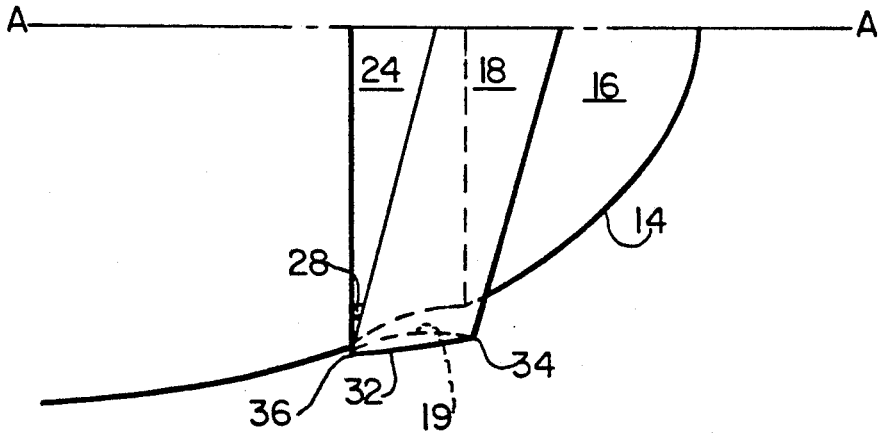
FIG. 5 is an enlarged schematic view of the embodiment shown in FIGS. 1-3 taken as indicated in FIG. 3.

As shown by hidden lines in FIGS. 4 and 5, annular member 18 preferably has a fluid foil cross-section 19. When annular member 18 is angularly displaced, as shown in FIGS. 3, 4 and 5, one side 30 of annular member 18 will be displaced forwardly, and an opposite side 32 will only be slightly displaced and will remain near annular concavity 24. Side 32 therefore acts as a spoiler.

As best shown in FIG. 5, a leading edge 34 of side 32 protrudes from bow contoured surface 14. As the vehicle moves forwardly in the fluid medium, leading edge 34 projects outwardly into the fluid flow, thereby disrupting the flow about vehicle 10. Fluid, which absent the projection of leading edge 34 into the fluid flow would travel uninterrupted about the vehicle, instead becomes caught between a trailing edge 36 of side 32 and the annular concavity. Consequently, this disruption in flow introduces drag to this side of the vehicle. The greater drag on this side means that the vehicle will tend to steer in this direction.

On the other side, the annular member 18 acts as a thruster. As seen in FIG. 4, when annular member 18 is angularly displaced, a leading edge 38 of forwardly displaced side 30 is spaced away from the contoured surface of the bow, as is a trailing edge 39. The fluid flowing between annular member 18 and the bow 16 is forced to exit predominantly on side 30. Because the fluid path under member 18 is narrowed by the fluid foil and because the fluid outlet at trailing edge 39 is smaller than the fluid inlet at leading edge 38, the velocity of the fluid exiting at trailing edge 39 is greater than the velocity of the fluid entering at leading edge 38, resulting in a thruster effect on side 30 of the vehicle. The drag produced on side 32 coupled with the thrust produced on opposite side 30 causes the vehicle to turn toward side 32, i.e., in the direction toward which the annular member is turned or angled.

The annular member may be displaced by any conventional actuating means. In a preferred embodiment, actuating means 20 includes a plurality of actuators 28 mounted inside the skin of the vehicle and pivotally attached at one end 29a to body 12 and at the other end 29b to the annular member 18. The actuators are preferably hydraulic, although any type may be used. To achieve the angular displacement described herein, each actuator 28 must be individually operable, thereby permitting the displacement of each actuator to be individually controlled by conventional hydraulic controls, not shown. It is also preferred that at least four actuators 28 be provided and that the actuators be equally spaced around the circumference of the vehicle bow.

The apparatus ma be used to steer the vehicle in any direction: up, down, to either side, or in a climbing or diving turn.

The pivoting action of actuators 28 is evident in comparing FIG. 2 with FIG. 3: in FIG. 2 the actuators are perpendicular to the plane of annular member 18 and to a plane perpendicular to the centerline of the vehicle, in FIG. 3, the actuators are at angles to both these planes.

Although annular member 18 will usually be used to steer the vehicle, as shown in FIG. 3, it may also be used in the position shown in FIG. 2 as a spoiler brake. This would help the vehicle slow down faster than it normally could.

The method of the present invention is performed by displacing the annular member forwardly. When the annular member is displaced at an angle to the longitudinal axis of the vehicle, a drag is produced by the spoiler at side 32 and a thrust is produced on the other or opposite side of the vehicle simultaneously. This combination of producing both a thrust and a drag on opposite sides of the vehicle creates a moment that forces the bow in the direction of the drag.

It can thus be seen that the present invention provides a relatively simple auxiliary steering assembly and method. When this steering assembly is coupled with conventional vehicular steering mechanisms, the maneuverability of the vehicle, particularly at low speeds, is greatly enhanced.

From the foregoing detailed description, it will be evident that there are a number of changes, adaptations and modifications of the present invention which could be made. However, it is intended that all such variations not departing from the spirit of the invention be considered as within the scope thereof, limited solely by the appended claims.

I claim:

1. A steering control assembly for use on a vehicle traveling through a fluid medium, said vehicle having a body formed with a contoured surface and a forward portion forming a bow, said assembly comprising:

an annular member surrounding said bow;

actuating means secured to said body for movement of said annular member forward and away from said bow at an angle to the longitudinal axis of said vehicle;

wherein when said annular member is displaced at said angle, said vehicle is caused to turn in the direction toward which said annular member is turned.

2. An assembly according to claim 1 wherein said annular member has an outer surface complementary to said contoured surface of said body.

3. An assembly according to claim 1 wherein said annular member includes a fluid foil in cross-section.

4. An assembly according to claim 1 further comprising a means for receiving said annular member.

5. An assembly according to claim 4 wherein said receiving means comprises an annular concavity extending circumferentially around said bow.

6. An assembly according to claim 1 further comprising said annular member extending longitudinally along said axis and forming a spoiler when extended out from said bow.

7. An assembly according to claim 6 wherein said spoiler includes a leading portion of said annular member projecting outwardly into the flow of said fluid about said vehicle.

8. An assembly according to claim 1 wherein said annular member further includes a trailing edge, said trailing edge and said contoured surface of said bow forming a thruster when said annular member is forwardly displaced.

9. An assembly according to claim 6 wherein said annular member further includes a trailing edge, said trailing edge and said contoured surface of said bow forming a thruster when said annular member is forwardly displaced.

10. An assembly according to claim 1 wherein said actuating means comprises a plurality of actuators.

11. An assembly according to claim 10 wherein each of said actuators is independently operable.

12. An assembly according to claim 10 wherein said plurality of actuating means is equally spaced about the circumference of said vehicle.

13. An assembly according to claim 10 further comprising four of said actuators.

14. An assembly according to claim 10 wherein each of said actuators is independently pivotally mounted.

15. An assembly according to claim 14 wherein each one of said actuators is pivoted at one end to said body and at the other end to said annular member.

16. A steering control assembly for use on a vehicle traveling through a fluid medium, said vehicle having a body formed with a contoured surface and a forward portion forming a bow, said assembly comprising:

an annular member surrounding said bow;

actuating means secured to said body for movement of said annular member forward and away from said bow at an angle to the longitudinal axis of said vehicle;

a means for receiving said annular member comprising an annular concavity extending circumferentially around said bow;

said annular member extending longitudinally along and at an angle to said axis to act as a spoiler when extended outwardly from said bow, said spoiler including a leading portion of said annular member projecting outwardly into the flow of said fluid about said vehicle; and said annular member including a trailing edge, said trailing edge and said contoured surface of said bow forming a thruster when said annular member is forwardly displaced;

wherein when said annular member is displaced at said angle, said spoiler formed on a side of said vehicle and said thruster formed on an opposite side of said vehicle cause said vehicle to turn in the direction toward which said annular member is turned.

17. An assembly according to claim 16 wherein said annular member has an outer surface complementary to said contoured surface of said body.

18. An assembly according to claim 16 wherein said annular member includes a fluid foil in cross-section.

19. An assembly according to claim 16 wherein said actuating means comprises a plurality of actuators.

20. An assembly according to claim 19 wherein each of said actuators is independently operable.

21. An assembly according to claim 19 wherein said plurality of actuating means is equally spaced about the circumference of said vehicle.

22. An assembly according to claim 19 further comprising four of said actuators.

23. An assembly according to claim 16 wherein said actuating means comprises a plurality of independently pivotally mounted actuators.

24. An assembly according to claim 23 wherein each one of said actuators is pivoted at one end to said body and at the other end to said annular member.

25. A steering control assembly for use on a vehicle traveling through a fluid medium, said vehicle having a body formed with a contoured surface and a forward portion forming a bow, said assembly comprising:

an annular member surrounding said bow;

actuating means secured to said body for movement of said annular member forwardly and away from said bow;

said annular member extending longitudinally along said axis and forming a spoiler when extended out from said bow, said spoiler including a leading portion of said annular member projecting outwardly into the flow of said fluid about said vehicle; and said annular member including a trailing edge, said trailing edge and said contoured surface of said bow forming a thruster when said annular member is forwardly displaced;

wherein when said annular member is displaced, said spoiler formed on a side of said vehicle and said thruster formed on an opposite side of said vehicle cause said vehicle to turn in the direction of said annular member.

26. An assembly according to claim 25 including, a means for receiving said annular member, said receiving means comprising an annular concavity extending circumferentially around said bow and wherein said annular member has an outer surface complementary to said contoured surface of said body.

27. An assembly according to claim 26 wherein said annular member includes a fluid foil in cross-section.

28. An assembly according to claim 27 wherein said actuating means comprises a plurality of independently operable actuators for displacing said annular member at an angle to axis.

29. A method for steering a vehicle traveling through a fluid medium, the vehicle having a body formed with a contoured surface and a forward part forming a bow, said method comprising, providing an annular member surrounding said bow, displacing said annular member forwardly at an angle producing drag on one side of said vehicle from a spoiler formed by said annular member while extending said annular member from said bow, producing a thrust on another side of said vehicle between said annular member and said bow while extending said annular member from said bow, establishing a moment from the drag on one side of said vehicle and the thrust on the other side, turning said vehicle in said fluid medium in the direction of said drag by means of the moment produced from said drag on one side and said thrust on the other side of said vehicle.

* * * * *